US005823901A

United States Patent [19]

Burger

[11] Patent Number: 5,823,901

[45] Date of Patent: Oct. 20, 1998

[54] HOCKEY STICK BLADE AND HANDLE AND METHOD OF SECURING SAME

[75] Inventor: George Burger, Rockland, Calif.

[73] Assignee: Hillerich & Bradsby Co., Inc., Louisville, Ky.

[21] Appl. No.: 490,334

[22] Filed: Jun. 14, 1995

[51] Int. Cl.[6] ..... A63B 59/12

[52] U.S. Cl. ..... 473/560

[58] Field of Search ..... 273/67 A; 473/305, 473/306, 307, 308, 309, 310, 311, 312, 560

[56] References Cited

U.S. PATENT DOCUMENTS

| | | | |
|---|---|---|---|
| 1,334,189 | 3/1920 | Swanson | 473/306 |
| 1,543,636 | 6/1925 | Williamson | 473/306 |
| 1,601,770 | 10/1926 | Reach et al. | 473/307 |
| 1,932,902 | 10/1933 | McDowell | 473/306 |
| 2,018,897 | 10/1935 | Reach | 473/306 |
| 2,121,387 | 6/1938 | Houser | 473/308 |
| 2,171,483 | 8/1939 | Simonton | 473/306 |
| 4,553,752 | 11/1985 | Gibbons | 237/67 A |
| 5,039,089 | 8/1991 | Pelz | 473/312 |
| 5,183,264 | 2/1993 | Lanctot | 273/67 A |
| 5,511,776 | 4/1996 | Huru | 273/67 A |

FOREIGN PATENT DOCUMENTS

| | | | |
|---|---|---|---|
| 86713 | 2/1966 | France | 273/67 A |

*Primary Examiner*—Theatrice Brown

*Attorney, Agent, or Firm*—St. Onge Steward Johnston & Reens LLC

[57] ABSTRACT

In a two piece hockey stick, or some other tool or sporting apparatus including a handle and a blade or implement portion, the handle is secured to the blade by means of inserting a tapered screw into an aperture in the shaft of the blade and tightening the screw, which causes the shaft of the blade to enlarge and fit snugly within the hollow handle.

5 Claims, 5 Drawing Sheets

HOCKEY STICK BLADE AND HANDLE AND METHOD OF SECURING SAME

FIELD OF THE INVENTION

This invention relates to hockey sticks, and more particularly to a method of securing a hockey stick blade and shaft into a hollow handle, in a two-piece hockey stick.

BACKGROUND

One-piece hockey sticks comprised entirely of wood, although still being manufactured for smaller children, are seldom now used by adults, or professional hockey players. Today's hockey sticks are comprised of a hollow handle made from aluminum which is adapted to fit over the shaft of the hockey stick blade. Thus, as hockey stick blades tend to break more often than the handle, replacement blades can be purchased and reinserted into the previous hollow handle.

In present day applications, the blade and hosel of the hockey stick are secured within the hollow aluminum handle by using hot-melt adhesives. This practice of securing the hosel or tenon of the blade within the hollow shaft by using adhesives has several drawbacks. It often takes too long to heat up the shaft and tenon in order to remove a broken blade or insert a replacement blade. In order to heat the shaft, electrical or flame heat is required. If electrical heat is used, it will require the use of some sort of electrical heating device which is an additional cost, and requires an electrical outlet which is sometimes not available. If flame heat is used, there is a high probability of damaging the blade or shaft due to the excessively high temperature produced.

Due to the nature of adhesives, one can never be 100% assured that there is an adequate bond between the shaft and blade. If insufficient heat is applied, a poor bond results between the blade and shaft. Similarly, if the operator is inexperienced and insufficient hot melt adhesive is applied to the interface, there will be insufficient hot melt adhesive pushed into the shaft by the insertion of the tenon or hosel. Again, a poor bond will result.

Another problem that plagues the industry is that there are many manufacturers of replacement blades and hollow handles and unless there is a small degree of tolerance, the fit will not be secure.

It is an object of the present invention to connect the two portions of the hockey stick mechanically.

It is also an object of the present invention to secure the hosel of the blade in the hollow handle by means of mechanically increasing the cross section of the hosel once it has been placed within the hollow handle.

The inventor of the present invention has found that by slitting the hosel along its longitudinal axis and boring an aperture in the end of the shaft, a tapered screw can be inserted in the aperture and tightened after the hollow handle has been placed over the shaft.

The tightening of the screw can be accomplished in various ways, i.e. from the top or the bottom, by inserting the correct tool therein.

In one embodiment, an elongated screw driver can be inserted through the open top of the handle and the screw tightened from the top, by means of a slot-type, Robertson, or Phillips fitting.

In a preferred embodiment, the shaft of the hockey stick blade has a bore hole at its upper end. The bore hole extends at a slight angle to the longitudinal axis of the handle emerging from the side of the handle near the heel of the blade. The upper end is split so that when a tapered screw is inserted into the bore hole and tightened, the upper end of the shaft of the blade expands within the handle. The screw has an aperture in the small end which is adapted to accept or receive the end of an Allen wrench. When the screw Is inserted within the bore hole, and the hollow metal handle is mounted on the blade shaft, a socket wrench can be inserted through the lower end of the bore hole near the heel of the blade. The wrench can be used to tighten the screw by drawing it inwardly, thereby causing the shaft of the blade to expand within the metal handle so as to lock the blade and handle together.

Therefore, this invention seeks to provide a hockey stick comprising a hollow handle, a blade and a tapered screw; said blade including a shaft at one end; said shaft including, on an upper portion, a hosel; said hosel having a smaller width and thickness than said shaft and being adapted to fit within said hollow handle; said hosel further comprising a centrally located slit extending across the entire thickness of said hosel; said hosel further comprising a centrally located bore hole at its upper end, adapted to receive said tapered screw wherein, in operation, said hosel is placed within said hollow handle and said tapered screw is turned into said bore hole, thereby causing said hosel to widen in dimension to fixedly lock said blade in said handle.

It should also be emphasized that this invention is intended to have many applications and is not limited to hockey sticks. For example, any tool or piece of sporting equipment such as paddles, rackets, etc., which have a hollow upper handle and a lower shaft portion can be put together by using the present invention.

BRIEF DESCRIPTION OF THE DRAWINGS

This invention will be described in greater detail in conjunction with the accompanying drawings wherein.

DETAILED DESCRIPTION OF THE INVENTION

Figure 1:
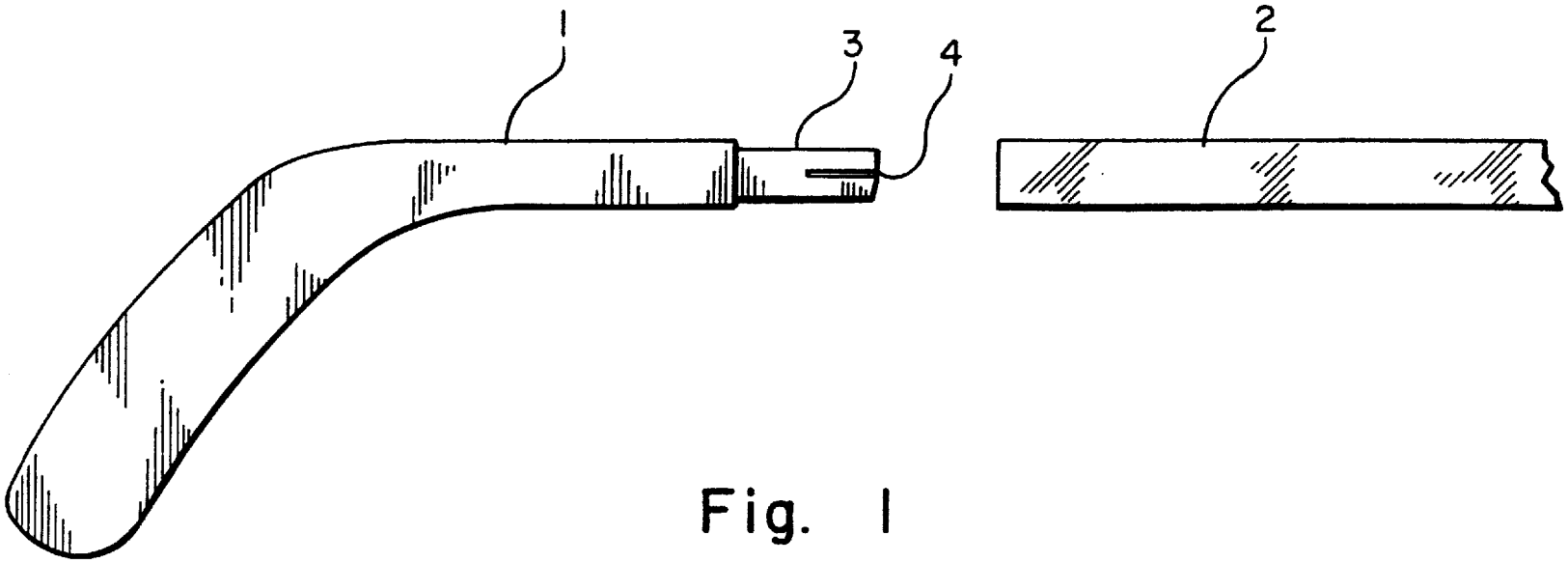
FIG. 1 is a side view of the basic components of a two piece hockey stick.

In FIG. 1, a hockey stick blade shaft component 1 and a hollow handle 2 are shown. The upper portion of the blade shaft comprises a hosel 3 which is of lesser of dimensions in width and thickness than both the shaft portion of the blade 1 and the interior dimensions of the hollow handle 2. A longitudinal slit 4 is cut in the hosel 3. The slit 4 can terminate part way along the hosel or cut through the entire length of the hosel.

Figure 2:
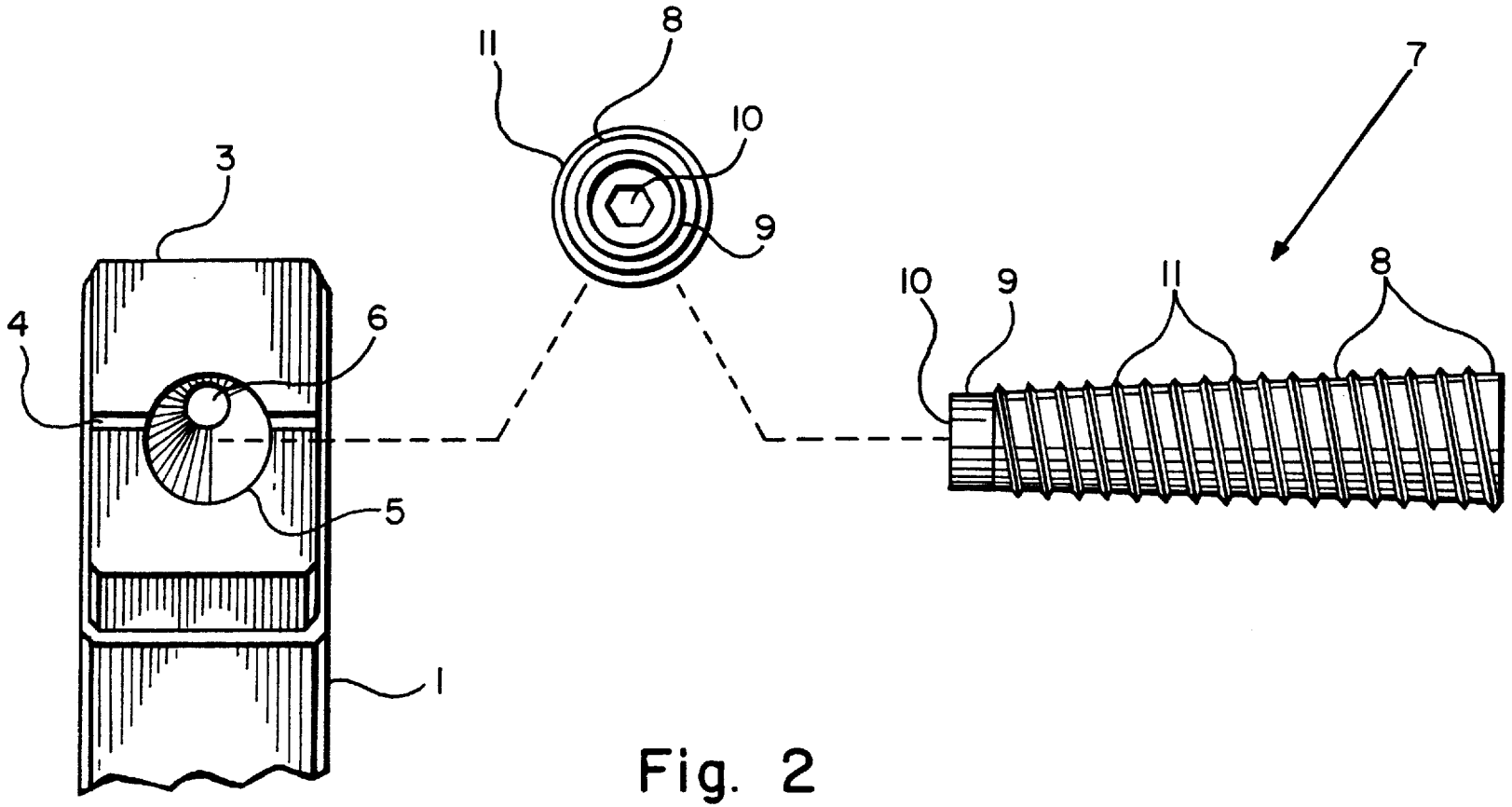
FIG. 2 is an exploded view of the tapered screw and an end view of the hockey stick shaft.

Examining FIG. 2, the hosel 3, at its upper end, contains an aperture 5. The aperture shown in this embodiment is tapered, opening through the heel of the stick with a smaller aperture 6. On the right side of FIG. 2, one views a tapered screw 7 which is adapted to fit into aperture 5. Tapered screw 7 tapers from the upper portion 8 to a smaller diameter at the lower end 9. Threads 11 are adapted to engage the aperture 5. A tool receiving recess is in the form of a hexagon 10 at the lower end of the tapered screw.

Figure 3:
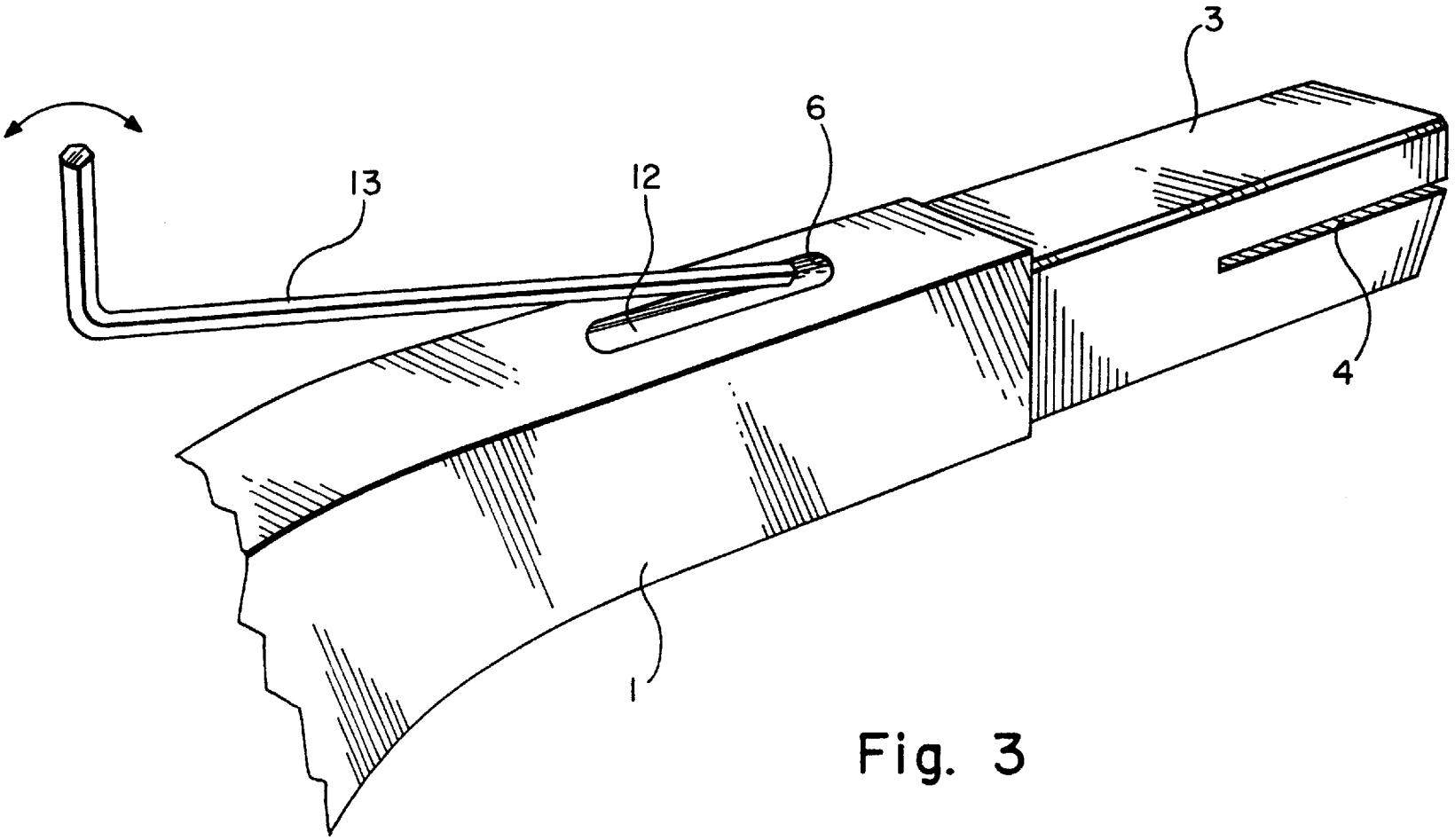
FIG. 3 is a perspective view of the shaft and hosel of the hockey stick blade.

In FIG. 3, aperture 6 is in the form of a slot 12 such that the tapered hole 5 ending in aperture 6 continues along the heel of the shaft of the blade 1. The slot 12 and aperture 6 are adapted to receive an Allen wrench 13.

Figure 4:
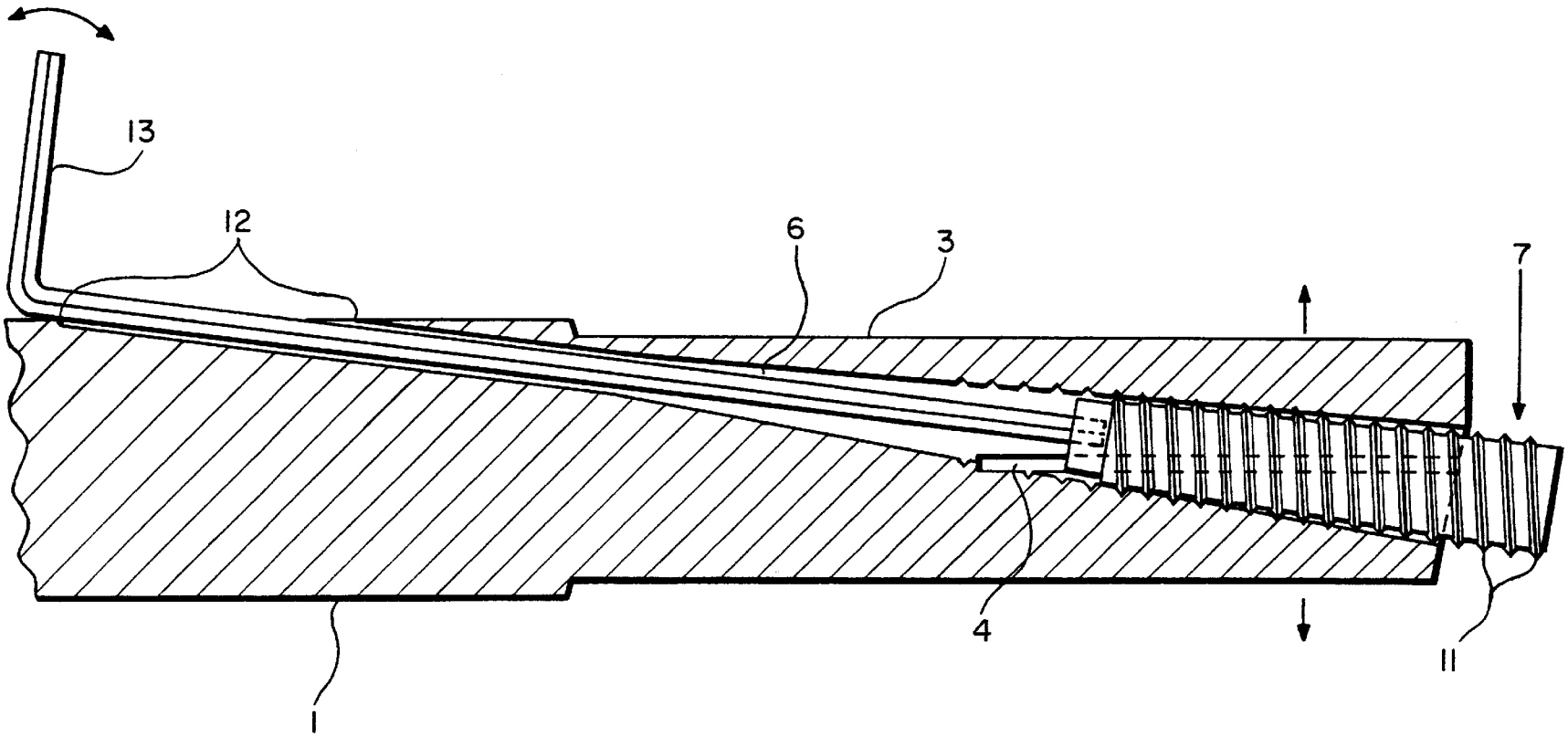
FIG. 4 is a longitudinal cross-section of the hosel and shaft portion of the blade.

In FIG. 4, the tapered screw 7 is shown turned part way into bore hole 5. An Allen wrench 13 has been inserted through the lower end of the bore hole 6 to matingly engage the tool receiving recess 10 (not shown in FIG. 4).

Figure 5:
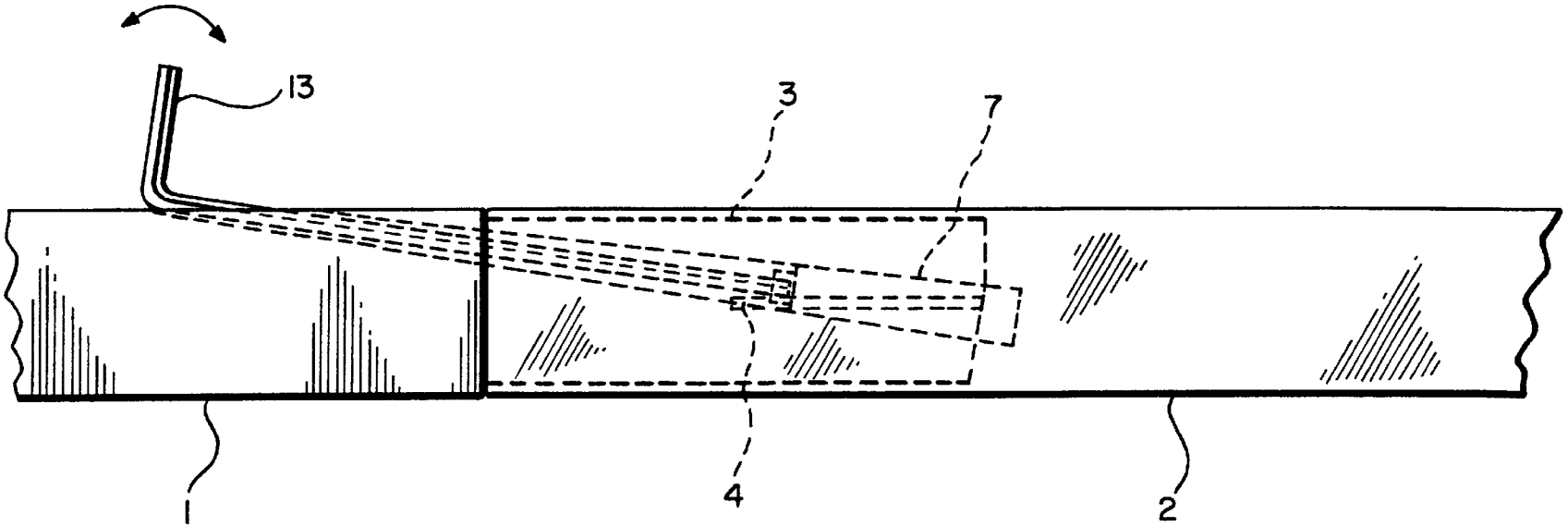
FIG. 5 is a longitudinal cross-section of the hollow handle in place on the hosel of the blade.

Finally, in operation, as shown in FIG. 5, the hollow handle 2 is placed over the hosel 3 after the screw 7 has been inserted into the bore hole 5. A turning of the end of Allen wrench 13 in a clockwise direction will cause the screw 7 to tighten in the bore hole and therefore wedge the two sides of the split hosel 3 outwardly, thereby creating a strong mechanical fit between handle 2 and shaft 1. Thereafter, the Allen wrench 13 will be removed.

In the event that the blade portion 1 of the hockey stick breaks or must be replaced, the Allen wrench is simply reinserted and matingly engages aperture 10 of screw 7. As the wrench is turned counter clockwise the tapered screw 7 is released from aperture 5, thereby permitting hollow handle 2 to be removed from the hosel 3.

What I claim as my invention is:

1. A hockey stick comprising:

an elongated handle having first and second ends, a blade having an object contact end and a free hosel end for attaching said blade to said first end of said handle, said hosel having a predetermined length along said blade, said hosel end having a slit extending a predetermined distance along said predetermined length;

said hosel further having a bore extending at an angle from said hosel free end towards said object contact end, and exiting through the side of said blade at a location spaced from said hosel free end;

a screw; said screw having a large diameter end and a small diameter end to thereby define a tapered configuration; said screw having a longitudinal recess in its small diameter end, said recess being configured to receive a tool;

said screw large diameter end being larger than the cross-sectional area of said bore;

said screw having its small diameter end inserted into said bore at said free hosel end such that said free hosel end will expand as said screw is turned to advance into said bore;

said hosel, when inserted into said handle first end will be fixedly locked therein as said screw 13 manually advanced into said bore by a said tool.

2. A hockey stick as defined in claim 1 wherein; said bore is tapered such that it is larger in diameter at said free hosel end than at said side of said blade.

3. A hockey stick as defined in claim 1 wherein; said recess in said tapered screw is multi-sided; said recess being adapted to matingly engage a said tool when in operation; said tool being adapted to turn said screw into said bore or conversely remove said screw from said bore.

4. A hockey stick as defined in claim 1 wherein; said recess is hexagonal in shape and said tool has a portion thereof corresponding in shape to said recess.

5. A hockey stick as defined in claim 1 wherein, said tapered screw includes a slot at said small end, said slot being adapted to matingly engage a screw driver, such that in manual operation, said screw driver may tighten or loosen said screw in said bore.

* * * * *